US007664592B2

(12) United States Patent
Asano et al.

(10) Patent No.: US 7,664,592 B2
(45) Date of Patent: Feb. 16, 2010

(54) FUEL INJECTION CONTROL APPARATUS

(75) Inventors: Masahiro Asano, Kariya (JP); Eiji Takemoto, Oobu (JP); Yuuki Tarusawa, Kariya (JP)

(73) Assignee: Denso Corporation, Kariya (JP)

( * ) Notice: Subject to any disclaimer, the term of this patent is extended or adjusted under 35 U.S.C. 154(b) by 66 days.

(21) Appl. No.: 12/146,173

(22) Filed: Jun. 25, 2008

(65) Prior Publication Data

US 2009/0025688 A1 Jan. 29, 2009

(30) Foreign Application Priority Data

Jul. 23, 2007 (JP) ..... 2007-191097

(51) Int. Cl.
*F02D 41/04* (2006.01)

(52) U.S. Cl. ..... 701/104; 701/109; 123/486; 123/674

(58) Field of Classification Search ..... 701/104, 701/106; 123/486, 674
See application file for complete search history.

(56) References Cited

U.S. PATENT DOCUMENTS 6,907,861 B2 6/2005 Asano et al.
6,990,958 B2 * 1/2006 Asano et al. ..... 123/436
7,287,515 B2 * 10/2007 Okamura et al. ..... 123/494
7,363,912 B2 * 4/2008 Asano et al. ..... 123/436
7,474,952 B2 * 1/2009 Sugiyama ..... 701/104

FOREIGN PATENT DOCUMENTS

JP 2005-36788 2/2005

* cited by examiner

*Primary Examiner*—Erick Solis
(74) *Attorney, Agent, or Firm*—Nixon & Vanderhye P.C.

(57) ABSTRACT

The fuel injection control apparatus includes a function of making a determination of whether learning conditions are satisfied to allow a fuel injection amount learning to be performed, a function of directing a commanded fuel injection amount in the fuel injection amount learning to a fuel injection valve if result of the determination is affirmative, a function of setting an upper limit value of an injection pressure in the fuel injection amount learning, a function of setting a target injection pressure in the fuel injection amount learning, a function of setting the injection pressure to the target injection pressure, a function of detecting an actual fuel injection amount, and a function of correcting an amount of fuel injected by the fuel injection valve on the basis of a difference between the commanded fuel injection amount and the actual fuel injection amount at the target injection pressure.

7 Claims, 5 Drawing Sheets

FUEL INJECTION CONTROL APPARATUS

CROSS-REFERENCE TO RELATED APPLICATION

This application is related to Japanese Patent Application No. 2007-191097 filed on Jul. 23, 2007, the contents of which are hereby incorporated by reference.

BACKGROUND OF THE INVENTION

1. Field of the Invention

The present invention relates to a fuel injection control apparatus for correcting an amount of fuel injected by a fuel injection valve, and a fuel injection system including the fuel injection control apparatus.

2. Description of Related Art

There is known a fuel injection control apparatus configured to detect an actual fuel injection amount of a fuel injection valve on the basis of variation of a running state of an engine such as variation of an engine speed due to fuel injection, and correct a fuel injection amount depending on the difference between a commanded fuel injection amount directed to the fuel injection valve and the actual fuel injection amount. For example, refer to Japanese Patent application Laid-open No. 2005-36788.

Particularly, in the case of a diesel engine, it is necessary to perform a fuel injection amount learning in order to enable precisely correcting a fuel injection amount at the time of carrying out a small amount fuel injection (may be referred to as "pilot injection" hereinafter) to reduce NOx and combustion noise.

Since a fuel injection amount varies depending on the injection pressure, it is preferable to perform the fuel injection amount learning for each of different target injection pressures. Some of the conventional fuel injection amount control apparatuses are configured to perform the fuel injection amount learning by injecting fuel at a pressure deviated from a target injection pressure. In this case, since it is necessary to modify a learned injection amount correction value depending on the difference between the target injection pressure and the actual injection pressure, the correction accuracy of fuel injection amount is lowered.

In addition, since when predetermined conditions to allow the fuel injection amount learning to be performed are satisfied, the injection pressure is low in many cases, there is a problem that the range of the injection pressures at each of which the fuel injection amount learning is performed is biased toward the low-pressure side. It might occur that the injection pressure in the normal injection mode (may be referred to as "normal injection pressure") is set to the target injection pressure at the time of performing the fuel injection amount learning.

However, in this case, if the target injection pressure is higher than the normal injection pressure, there may be a problem that the injection pressure is not reduced to a sufficient degree when the normal injection mode is resumed. If the normal injection mode is resumed in a state where the injection pressure is not reduced to a sufficient degree, there occurs a large variation in the engine running state such as combustion noise and vibration of the engine. This may give concern to the driver of the vehicle.

Moreover, if the target injection pressure is too high, since the combustion noise and vibration of the engine are large, the driver may feel concern during the fuel injection amount learning.

SUMMARY OF THE INVENTION

The present invention provides a fuel injection control apparatus comprising:

a first function of making a determination of whether or not learning conditions are satisfied to allow a fuel injection amount learning to be performed for a fuel injection valve;

a second function of directing a commanded fuel injection amount in the fuel injection amount learning to the fuel injection valve if result of the determination is affirmative;

a third function of setting an upper limit value of an injection pressure in the fuel injection amount learning;

a fourth function of setting a target injection pressure within a range not exceeding the upper limit value in the fuel injection amount learning;

a fifth function of setting the injection pressure to the target injection pressure;

a sixth function of detecting an actual fuel injection amount of the fuel injection valve; and a seventh function of correcting an amount of fuel injected by the fuel injection valve on the basis of a difference between the commanded fuel injection amount and the actual fuel injection amount at the target injection pressure as a learned correction value.

The present invention also provides a fuel injection system comprising:

a fuel supply pump for pressure-feeding fuel;

a common rail for accumulating fuel pressure-fed from the fuel supply pump;

a fuel injection valve for injecting fuel accumulated in the common rail; and a fuel injection control apparatus for controlling a fuel injection amount of the fuel injection valve;

the fuel injection control apparatus comprising:

a first function of making a determination of whether or not learning conditions are satisfied to allow a fuel injection amount learning to be performed for the fuel injection valve or not;

a second function of directing a commanded fuel injection amount in the fuel injection amount learning to the fuel injection valve if result of the determination is affirmative;

a third function of setting an upper limit value of an injection pressure in the fuel injection amount learning;

a fourth function of setting a target injection pressure in the fuel injection amount learning;

a fifth function of setting the injection pressure to the target injection pressure;

a sixth function of detecting an actual fuel injection amount of the fuel injection valve; and a seventh function of correcting an amount of fuel injected by the fuel injection valve on the basis of a difference between the commanded fuel injection amount and the actual fuel injection amount at the target injection pressure as a learned correction value.

According to the present invention, it is possible to provide a fuel injection control apparatus and a fuel injection system that can correct a fuel injection amount for each of different injection pressure levels with a high degree of accuracy, without causing large variation in the running state of an engine being controlled by the fuel injection control apparatus at the time of performing the injection amount learning.

Other advantages and features of the invention will become apparent from the following description including the drawings and claims.

PREFERRED EMBODIMENTS OF THE INVENTION

Figure 1:
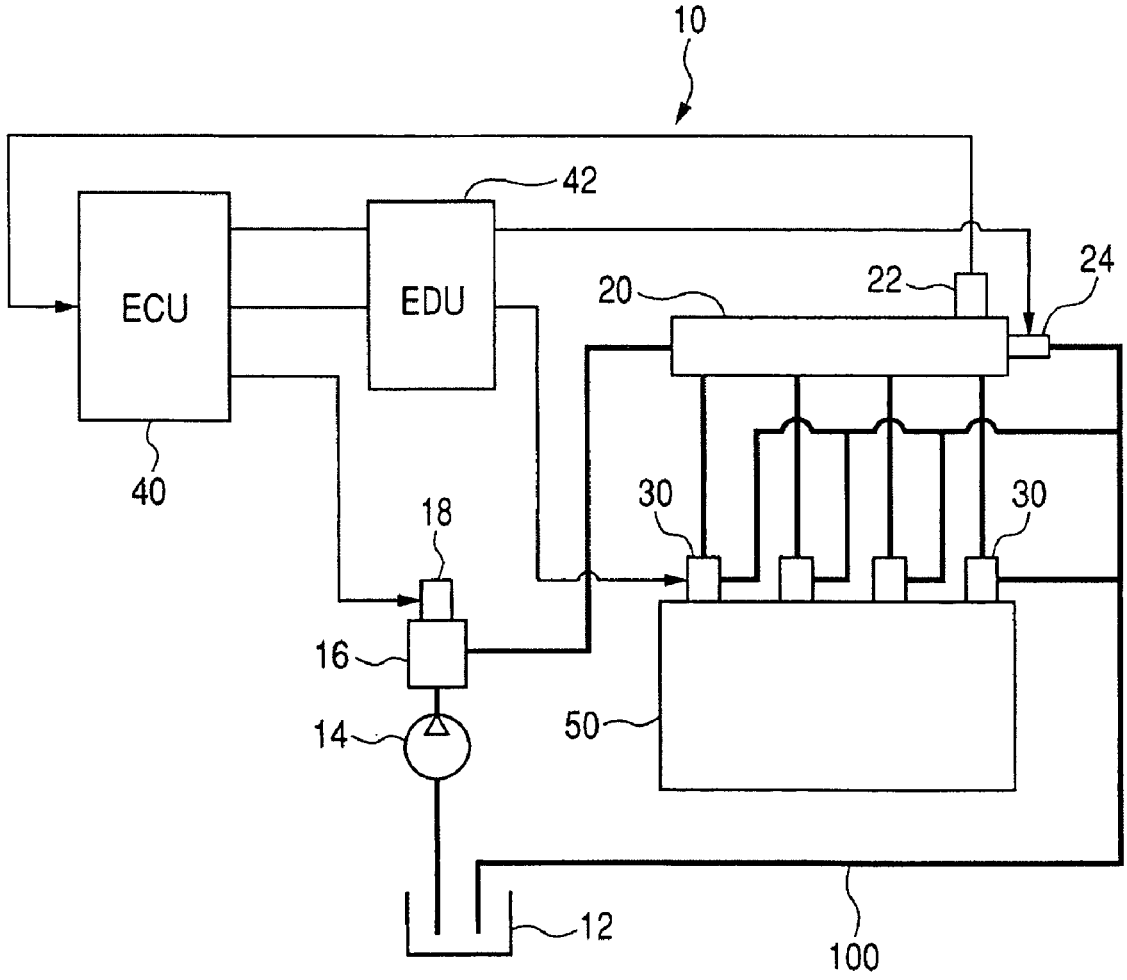
FIG. 1 is a diagram showing a structure of a fuel injection system of the pressure accumulation type according to an embodiment of the invention.

FIG. 1 is a diagram showing a structure of a fuel injection system 10 of the pressure accumulation type according to an embodiment of the invention. The fuel injection system 10, which is for injecting fuel into each cylinder of a four-cylinder diesel engine 50, is constituted mainly of a feed pump 14, a high-pressure pump 16, a common rail 20, a pressure sensor 22, a pressure-reducing valve 24, fuel injection valves 30, an ECU (Electronic Control Unit) 40, and an EDU (Electronic Driving Unit) 42. To simplify the drawing, only one of control signal lines lying from the EDU 42 to the fuel injection valves 30 is shown in FIG. 1.

The feed pump 14 takes fuel from a fuel tank 12, and supplies it to the high-pressure pump 16 operating as a fuel supply pump. The high-pressure pump 16 pressurizes the fuel into a compression chamber thereof by the action of a plunger reciprocating with the rotation of a cam mounted on a camshaft. The ECU 40 controls a current supplied to a metering valve 18 of the high-pressure pump 16 to meter the amount of fuel which the high-pressure pump 16 takes in the suction cycle thereof. By metering the fuel amount, the fuel discharge amount of the high-pressure pump 16 can be adjusted.

The common rail 20 accumulates fuel pressure-fed from the high-pressure pump 16, and holds the fuel pressure at a predetermined high pressure depending on the running state of the engine. The pressure of the common rail 20 (may be referred to as "common rail pressure" hereinafter) is controlled by the discharge amount of the high-pressure pump 16 and the pressure-reducing valve 24. The pressure sensor 22 detects the common rail pressure, and outputs a signal indicative of the detected pressure to the ECU 40.

The pressure-reducing valve 24 discharges, by an opening motion thereof, fuel within the common rail 20 into a low-pressure side return pipe 100 to reduce the common rail pressure. The pressure-reducing valve 24 may be an electromagnetic valve which opens by passing an electric current to its electromagnetic driving section such as a coil to lift a valve member thereof applied with a spring load in the valve closing direction against the spring load. The valve open time period of the pressure-reducing valve 24 increases with the increase of a pulse width of a power supply pulse signal supplied thereto.

The fuel injection valve 30, which is located in each cylinder of the 4-cylinder diesel engine 50, injects fuel accumulated in the common rail 20 into the cylinder. The fuel injection valve 30 carries out a multi-stage injection including a pilot injection, a main injection, and a post injection in one combustion cycle of the diesel engine. The fuel injection valve 30 valve is an electromagnetically driven type valve configured to control the fuel injection amount by controlling the pressure in a control chamber thereof which applies the fuel pressure to a nozzle needle thereof in the valve closing direction.

The ECU 40 which operates as a fuel injection control apparatus is a microcomputer-based apparatus including a CPU, and memory devices including a ROM, a RAM, and a non-volatile rewritable memory such as a flash memory. The ECU 40 detects a running state of the diesel engine 50 on the basis of detection signals of various sensors including an accelerator sensor detecting an opening degree of an accelerator pedal, a temperature sensor, the pressure sensor 22, an NE sensor detecting an engine speed, and an A/F sensor. The ECU 40 controls currents supplied respectively to the metering valve 18, pressure-reducing valve 24, and fuel injection valves 30, so that the diesel engine 50 is in an optimum running state.

The ECU 40 pre-stores a discharge characteristic of the high-pressure pump 16 showing a relationship between the current supplied to the metering valve 18 and the discharge amount of the high-pressure pump 16 in the memory device such as the ROM or flash memory in the form of a map. The ECU 40 feed-back controls the current supplied to the metering valve 18 on the basis of the discharge characteristic of the high-pressure pump 16 stored in the memory device, such that the common rail pressure detected by the pressure sensor 22 is kept at a target common rail pressure.

The ECU 40 also controls the injection timing and fuel injection amount of each fuel injection valve 30 in accordance with the running state of the engine obtained on the basis of the detection signals received from the various sensors including the pressure sensor 22. The ECU 40 outputs a pulse signal to the EDU 42 as an injection command signal to control the injection timing and the fuel injection amount of each fuel injection valve 30. The ECU 40 pre-stores a fuel injection amount characteristic showing a relationship between a pulse widths of the injection command signal and a fuel injection amount for each of different values of the common rail pressure.

The EDU 42 supplies a drive current or a drive voltage to each of the pressure-reducing valve 24 and the fuel injection valves 30 in accordance with the injection command signal.

The ECU 40 implements the following functions by a control program stored in the memory device such as the ROM or flash memory.

(1) Learning Condition Determining Function

The learning condition determining function determines that learning conditions are satisfied to allow an injection amount learning to be performed if the accelerator pedal is not pressed, and accordingly a vehicle on which the fuel injection system 10 is mounted is in a decelerating state because of no fuel injection.

(2) Injection Control Function

The injection control function outputs a pulse signal as the injection command signal designating an injection timing and a fuel injection amount of each fuel injection valve 30 to the EDU 42. As the pulse width of the pulse signal increases, the time period during which the control chamber of the fuel injection valve 30 is opened to the low-pressure side increases, and accordingly, the commanded fuel injection amount increases.

(3) Upper Limit Value Setting Function

If the common rail pressure as the target injection pressure at the time of performing a fuel injection amount learning (may be referred to as "injection amount learning" hereinafter) is too high, there occurs a large variation in the engine running state such as combustion noise and engine vibration while the injection amount learning is performed, and also when a normal injection control is resumed after the injection amount learning is completed. This may give concern to the occupants of the vehicle.

Accordingly, the upper limit value setting function sets an upper limit value of the target injection pressure within a range in which the injection pressure can be increased, on the basis of the common rail pressure, engine speed, etc., when the learning conditions are satisfied, in order to reduce the variation in the engine running state such as the combustion noise and vibration of the engine which occurs while the injection amount learning is performed, and when the normal injection control is resumed after the learning is completed.

The upper limit value set by the upper limit value setting function may be increased within the range in which the injection pressure can be increased in the following situations (3a) to (3e).

(3a) When the background noise is large, the noise occurring during the injection amount learning is less perceptible.

Accordingly, when the background noise is large, the upper limit value of the target injection pressure may be increased.

(3b) The noise that occurs during the injection amount learning is smaller when the commanded injection amount in the injection amount learning is smaller. Also, this noise is smaller when a multi-stage injection is carried out compared to when a single-stage injection is carried out.

When the noise that occurs during the injection amount learning is small, the upper limit value of the target injection pressure can be increased.

(3c) When the windows of the vehicle are closed, the noise outside the cabin is less perceptible to the vehicle occupants. Accordingly, when it is possible to detect the open/close state of each window, the upper limit value of the target injection pressure can be increased.

(3d) If there is provided a means for rapidly reducing the injection pressure after the injection amount learning is completed, since the injection pressure can be reduced to a sufficient degree before the normal injection control is resumed, the upper limit value of the target injection pressure can be increased.

(3e) If the time necessary to complete the injection amount learning is shorter, since the time period after completion of the injection amount learning and before resumption of the normal injection control, which is used for reducing the injection pressure, can be made longer, the upper limit value of the target injection pressure can be increased. The time necessary to complete the injection amount learning can be determined to be shorter in the following cases (a) to (d).

(a) The discharge amount of the high-pressure pump 16 is large, and accordingly, the common rail pressure can be increased to the target injection pressure in a short time.

(b) The engine speed is high, and accordingly the pressurizing capacity of the high-pressure pump 16 is high, in case the high-pressure pump 16 is driven in synchronization with the crank shaft of the engine.

(c) The engine speed is high, and accordingly the time necessary to complete the injection amount learning is short, in case the operation of the injection amount learning is controlled at a rate in proportion to the engine speed.

(d) The injection pressure before starting the injection amount learning is high, and accordingly the time needed to increase the injection pressure to the target injection pressure is short.

(4) Injection Pressure Setting Function

The injection pressure setting function sets the target injection pressure within a range below the upper limit value set by the upper limit value setting function. For example, the target injection pressure is set at the highest of different values of the common rail pressure for each of which the injection amount learning has not been performed yet.

(5) Injection Pressure Control Function

The injection pressure control function controls the common rail pressure at the target injection pressure in one of the following ways.

(5a) The common rail pressure is increased or reduced by controlling the metering valve 18 of the high-pressure pump 16 to thereby control the discharge amount of the high-pressure pump 16.

(5b) The common rail pressure is reduced by opening the control chamber of the fuel injection valve 30 to the low-pressure side to cause the fuel injection valve to carry out dry injection.

(5c) The common rail pressure is reduced by opening the pressure-reducing valve 24.

(5d) The common rail pressure is reduced by carrying out a post-injection during a period in which the diesel engine 50 does not generate torque.

(6) Actual Injection Amount Detecting Function

The actual injection amount detecting function calculates an actual amount of fuel injected by each fuel injection valve 30 on the basis of variation of the running state of the engine such as variation of the engine speed detected by the NE sensor, variation of oxygen consumption detected by the A/F sensor, etc.

(7) Injection Amount Correcting Function

The injection amount correcting function calculates an injection amount correction value on the basis of the difference between a commanded injection amount in the injection amount learning at the target injection pressure which the ECU 40 directs to each fuel injection valves 30, and the actual injection amount detected by the actual injection amount detecting function. The injection amount correcting function corrects an injection amount characteristic map for the target injection pressure in accordance with the calculated injection amount correction value. In consequence, the pulse width of the pulse signal (the injection command signal) corresponding to the commanded injection amount is changed so that the actual injection amount approaches the commanded injection amount.

(8) Noise Level Detecting Function

The noise level detecting function detects the level of the background noise from the engine speed, vehicle speed, etc. before performing the injection amount learning. The noise level detecting function determines that the level of the background noise is higher when the engine speed or vehicle speed is higher. The level of the background noise may be detected from the volume of an audio device mounted on the vehicle, or the running state of an air conditioner mounted on the vehicle. The upper limit setting function increases the target injection pressure in performing the injection amount learning with the increase of the level of the background noise.

(9) Pressure reducing function

The pressure reducing function reduces the common rail pressure when the injection amount learning is completed by opening the pressure-reducing valve 24, or carrying out dry injection by each fuel injection valve 30, or carrying out post-injection by each fuel injection valve 30 during a period in which engine torque is not generated.

Figure 2:
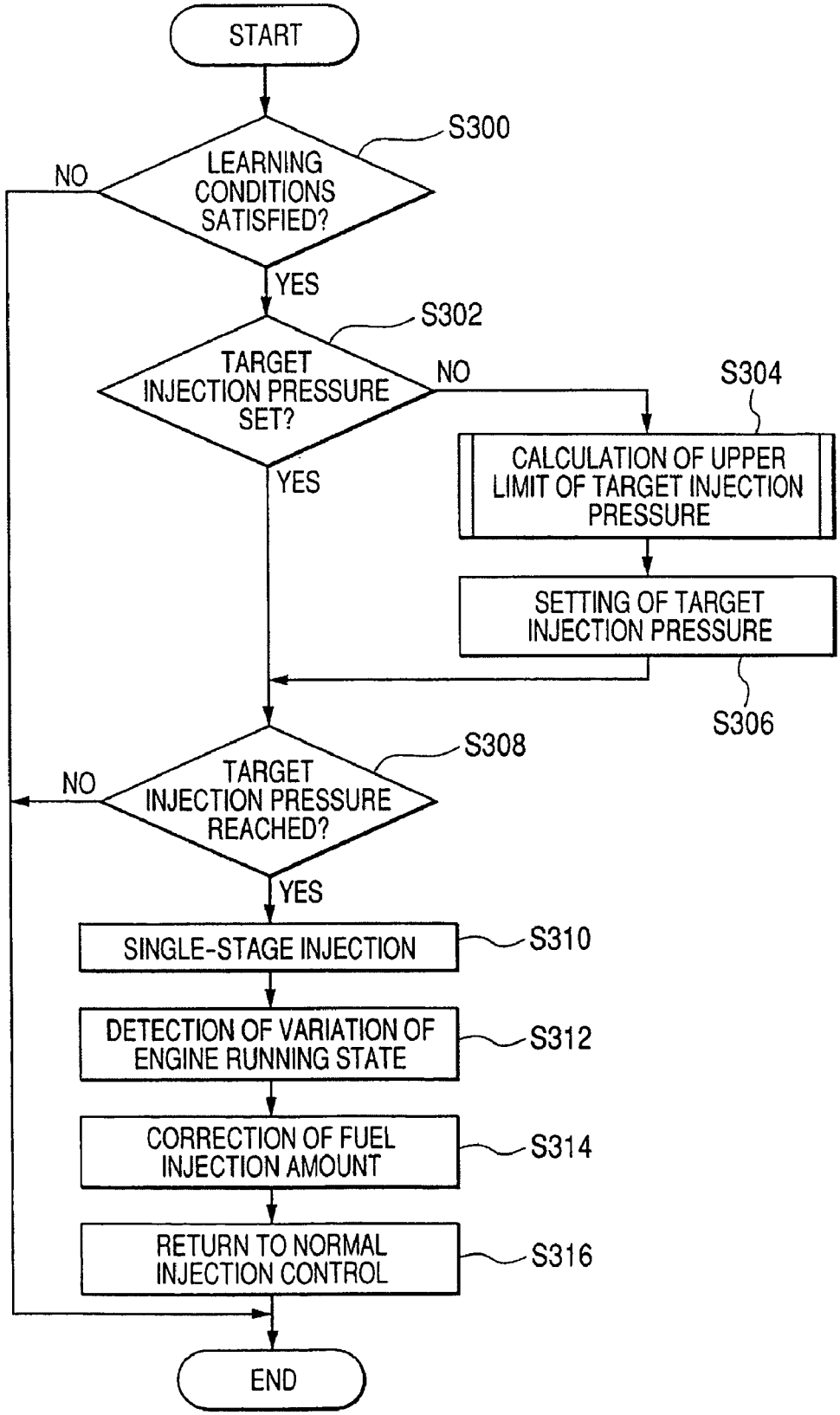
FIG. 2 is a flowchart showing steps of an injection amount learning routine performed by the fuel injection system.
Figure 3:
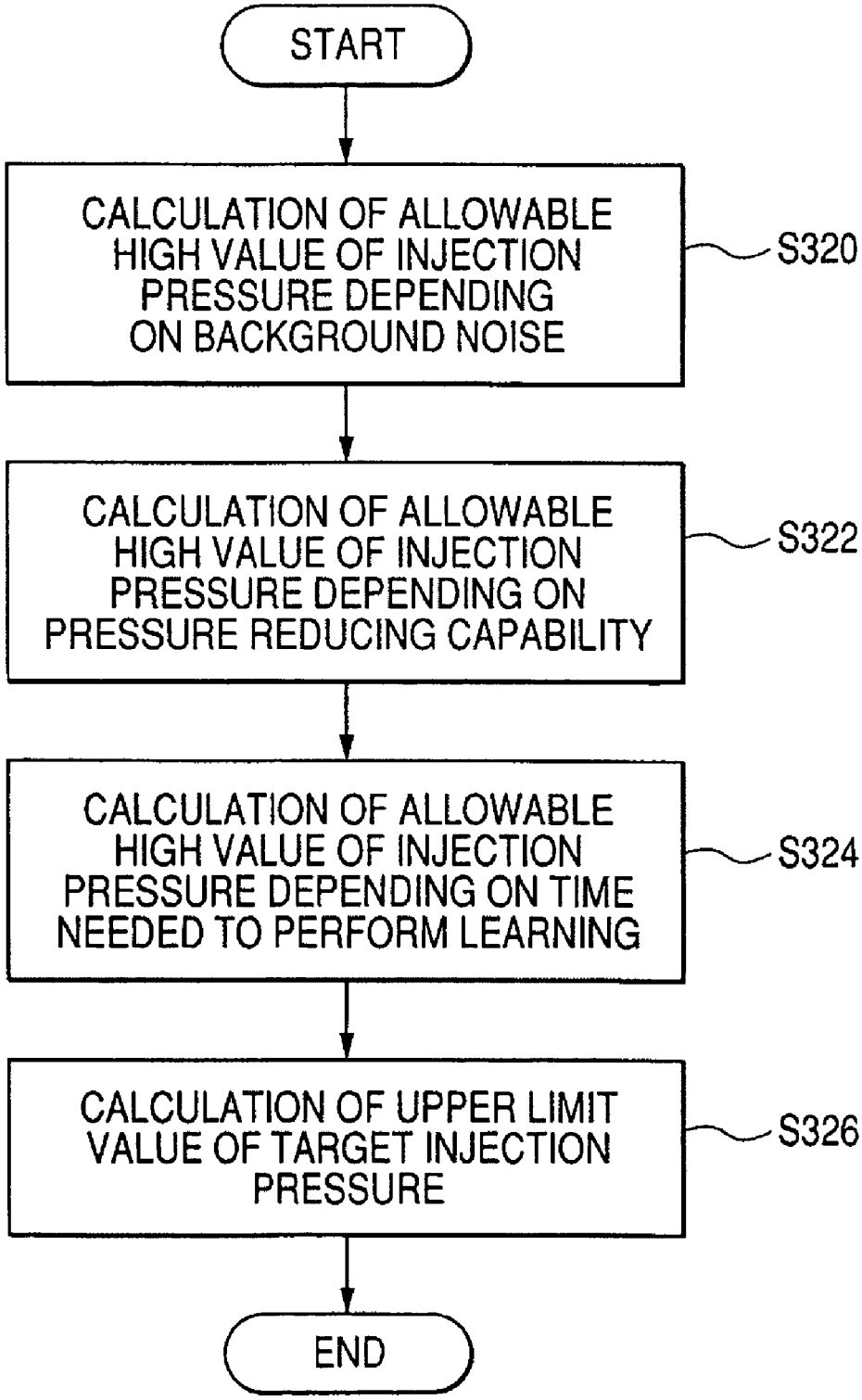
FIG. 3 is a flowchart showing steps of an upper limit value setting routine performed by the fuel injection system.

Next, the injection amount learning in the fuel injection system 10 is explained with reference to FIGS. 2 to 5. FIG. 2 is a flowchart showing steps of an injection amount learning routine performed in accordance with injection control timing in each cylinder. FIG. 3 is a flowchart showing steps of an upper limit value setting routine. The routines shown in FIG. 2 and FIG. 3 are stored in the memory device such as the RPM, or flash memory of the ECU 40.

As shown in FIG. 2, the injection amount learning routine begins by determining whether or not the learning conditions are satisfied to allow the injection amount learning to be performed. For example, the ECU 40 determines that the learning conditions are satisfied while the accelerator pedal is not pressed, and accordingly the engine speed is gradually decreasing because no fuel is injected from the injection valves 30. If the determination result at step S300 is affirmative, the routine proceeds to step S302, while if this determination result is negative this routine is terminated.

Here, even when the accelerator pedal is not pressed and accordingly the engine speed is gradually decreasing, if the engine speed is lower than a predetermined speed, the ECU 40 determines that the learning conditions are not satisfied. This is to prevent that the engine speed lowers to an idle speed, and in consequence the normal injection control is resumed before the injection amount learning is completed.

At step S302, the ECU 40 determines whether or not the target injection pressure in performing the injection amount learning has been set. The target injection pressure is set within a range below the upper limit value of the injection pressure at the time of performing the injection amount learning. If the determination result at step S302 is affirmative, the routine proceeds to step S308, while if this determination result is negative, the routine proceeds to step S304.

At step S304, the ECU 40 calculates and sets the upper limit value of the target injection pressure. Thereafter, at step S306, the ECU 40 sets the target injection pressure at the highest of the values of the common rail pressure within the range below the upper limit value, for each of which the injection amount learning has not been performed yet.

At step S308, the ECU 40 determines whether or not the common rail pressure has reached the target injection pressure. If this determination result is negative, the routine is terminated.

If the determination result at step S308 is affirmative, the ECU 40 commands the fuel injection valves 30 to carry out a single-stage injection to perform the injection amount learning at step S310. Instead of carrying out a single-stage injection, a multi-stage injection in which the same amount of fuel is injected plural times may be carried out. In this case, the ECU 40 calculates, as an injection amount per one injection, an average injection amount by dividing a total injection amount in the multi-stage injection by the number of injections.

Figure 4:
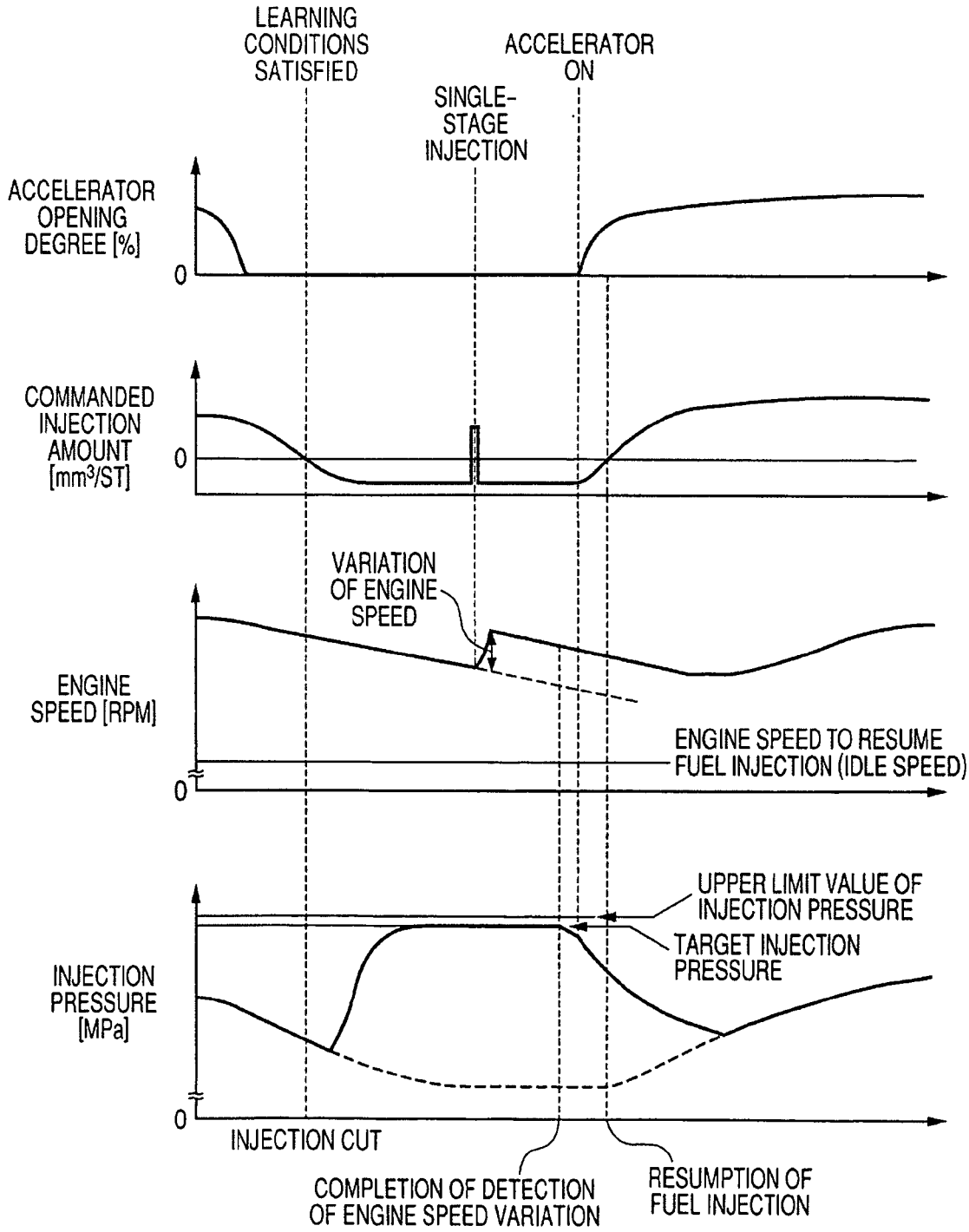
FIG. 4 is a time chart for explaining the operation of the injection amount learning routine.

At step S312, the ECU 40 detects variation of the running state of the engine due to the single-stage injection or multi-stage injection having been carried out. For example, the ECU 40 takes in the detection signals from the NE sensor and A/F sensor to calculate an actual amount of fuel injected by the fuel injection valve 30 which has carried out the single-stage injection or multi-stage injection on the basis of variation of the running state of the engine such as the engine speed and the oxygen consumption. In this embodiment, as shown in FIG. 4, the actual amount of fuel is calculated on the basis of the variation of the engine speed when the single-stage injection has been carried out.

At step S314, the ECU 40 calculates the injection amount correction value for the target injection pressure on the basis of the difference between the commanded injection amount and the actual injection amount, and corrects the injection amount characteristic map in accordance with the calculated injection amount correction value. At step S316, the ECU 40 opens the pressure-reducing valve 24 to reduce the common rail pressure in order to return from the injection amount learning control to the normal injection control. After that, the routine is terminated. When the driver presses the accelerator pedal to inject fuel from each fuel injection valve 30, the normal fuel injection control is resumed.

If the injection pressure at the time of resumption of the normal injection control after completion of the injection amount learning is higher by a certain value than the injection value in case the injection amount learning has not been performed, the ECU 40 performs one of the following operations (1) to (3) to reduce the noise generated by the fuel injection at the time of resumption of the normal injection control.

(1) Reducing the injection pressure as much as possible by delaying the timing at which the normal injection control is resumed.

(2) Reducing the injection amount at the time of resumption of the normal injection control.

(3) Switching to multi-stage injection.

In the explanation described above, the injection pressure is increased to perform the injection amount learning. However, if the injection pressure when the injection amount learning conditions are satisfied is higher than the highest of the values of the common rail pressure for each of which the injection amount learning has not been performed yet, the injection pressure at the time has to be reduced to perform the injection amount learning. In this case, the common rail pressure is increased at the time of completion of the injection amount learning by increasing the discharge amount of the high pressure pump 16.

Figure 5A:
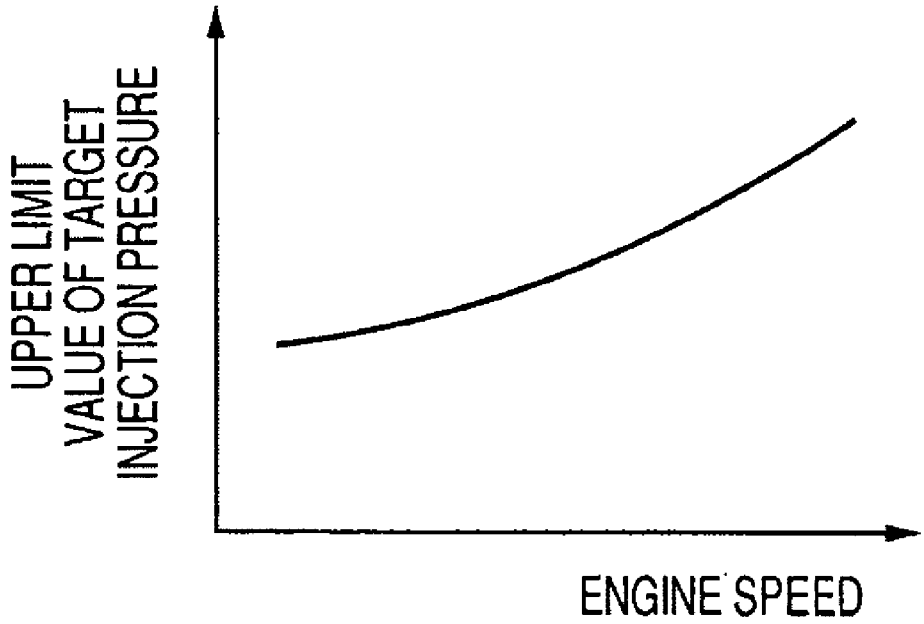
FIG. 5A is a diagram showing a relationship between the upper limit value of a target injection pressure, which is set depending on the level of the background noise, and an engine speed which affects the level of the background noise.
Figure 5B:
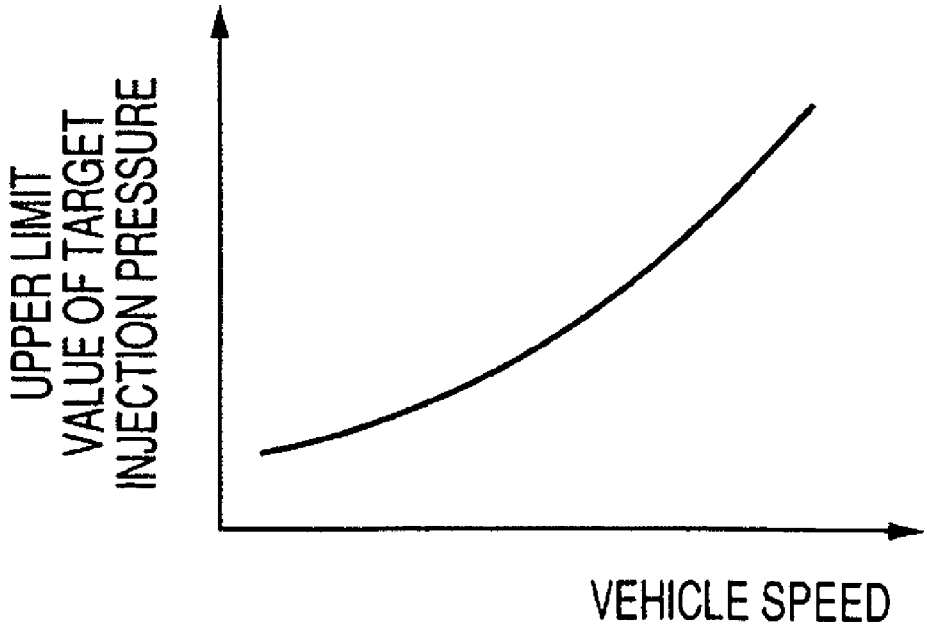
FIG. 5B is a diagram showing a relationship between the upper limit value of a target injection pressure, which is set depending on the level of the background noise, and a vehicle speed which affects the level of the background noise.

Next, the process of setting the upper limit value of the injection pressure performed at step S304 in FIG. 2 is explained. At step S320 in FIG. 3, the ECU 40 calculates a first allowable value indicative of a value up to which the target injection pressure is allowed to increase, on the basis of the level of the background noise. For example, when the engine speed is high, or vehicle speed is high, since the level of the background noise is high, the noise generated by the fuel injection is less perceptible to the vehicle occupants even if the target pressure is high. Accordingly, when the engine speed or vehicle speed is high, the ECU 40 determines that the level of the background noise is high, and increases the first allowable value so that the upper limit value of the target injection pressure increases with the increase of the engine speed or the vehicle speed as shown in FIG. 5.

At step S322, the ECU 40 calculates a second allowable value indicative of a value up to which the target injection pressure is allowed to increase, on the basis of the pressure reducing capability determined in accordance with the operation of the pressure-reducing valve 24, dry injection of each fuel injection valve 30, static leakage of each fuel injection valve 30, and post injection carried out by each fuel injection valve 30, etc. If the pressure reducing capability is higher, the second allowable value can be made larger, because as the pressure reducing capability increases, the time necessary to reduce the injection pressure to a sufficient degree before starting the normal injection control is reduced. If the injection pressure is reduced by causing each fuel injection valve to carry out dry injection, it is determined that the pressure reducing capability increases with the increase of the engine speed, because the number of times that the dry ignition is carried out increases with the increase of the engine speed.

At step S324, the ECU 40 calculates a third allowable value indicative of a value up to which the target injection pressure is allowed to increase, on the basis of the time required to perform the injection amount learning. If the time required to perform the injection amount learning is shorter, the time period after completion of the injection amount learning and before start of the normal injection control can be made longer, to thereby ensure the time period to reduce the injection pressure which has been increased to perform the injection amount learning. Accordingly, the third allowable value increases with the decrease of the time required to perform the injection amount learning.

At step S326, the ECU 40 calculates the upper limit value of the target injection pressure in performing the injection amount learning on the basis of the first, second and third allowable values respectively calculated at steps S320, S322, S324. The ECU 40 may set either a maximum or a minimum of the first, second and third allowable values as the target injection pressure.

As explained above, in this embodiment, the injection amount learning is performed not in a state where the common rail pressure as the injection pressure is unchanged from the time when the injection amount learning conditions are determined to be satisfied, but in a state where the common rail pressure is controlled to the target injection pressure within the range below the upper limit value. Accordingly, according to this embodiment, since it is not necessary to modify the learned correction value for correcting the injection amount, it is possible to correct the injection amount at the target injection pressure with a high degree of accuracy. This makes it possible to correct a small amount of fuel injection by post-injection with a high degree of accuracy, which is carried out before main injection in order to reduce the noise and NOx.

In addition, this makes it possible to prevent the values of the injection pressure for each of which the injection amount learning is performed being biased to the lower side, because the injection amount learning is performed at the target injection pressure set within the range below the upper limit value. Also, this makes it possible to prevent the injection pressure in performing the injection amount learning from increasing excessively, because the upper limit value of the injection pressure is set at the time of performing the injection amount learning. Also, this makes it possible to sufficiently reduce the injection pressure during the time period after completion of the injection amount learning and before start of the normal injection control. As a consequence, it becomes possible to prevent the running state of the engine such as the noise or vibration of the engine from changing excessively during the injection amount learning, and when the normal injection control is resumed.

It is a matter of course that various modifications can be made to the above described embodiment. For example, although the injection amount learning is performed while the accelerator is off, and accordingly while the vehicle decelerates due to no fuel injection in the above embodiment, it may be performed during idling of the engine at the target injection pressure set in the range below the upper limit value. Also in this case, it is possible to reduce as much as possible the noise generated by the fuel injection during the injection amount learning, and to correct the fuel injection amount at the target injection pressure with a high degree of accuracy.

The above embodiment describes an example in which the injection amount learning is performed in the accumulation type fuel injection system 10 in which fuel accumulated in the common rail 20 is injected from the fuel injection valves 30 into the cylinders of the diesel engine. However, the present invention is applicable to a fuel injection system not provided with a common rail, which is configured to inject fuel from fuel injection valves to a gasoline engine. In this case, the injection pressure in the fuel injection valve is detected on the basis of the pressure in a pipe for supplying fuel to the fuel injection valve.

The above explained preferred embodiments are exemplary of the invention of the present application which is described solely by the claims appended below. It should be understood that modifications of the preferred embodiments may be made as would occur to one of skill in the art.

What is claimed is:

1. A fuel injection control apparatus comprising:

a first function of making a determination of whether or not learning conditions are satisfied to allow a fuel injection amount learning to be performed for a fuel injection valve;

a second function of directing a commanded fuel injection amount in said fuel injection amount learning to said fuel injection valve if result of said determination is affirmative;

a third function of setting an upper limit value of an injection pressure in said fuel injection amount learning;

a fourth function of setting a target injection pressure within a range not exceeding said upper limit value in said fuel injection amount learning;

a fifth function of setting said injection pressure to said target injection pressure;

a sixth function of detecting an actual fuel injection amount of said fuel injection valve; and a seventh function of correcting an amount of fuel injected by said fuel injection valve on the basis of a difference between said commanded fuel injection amount and said actual fuel injection amount at said target injection pressure as a learned correction value.

2. The fuel injection control apparatus according to claim 1, further comprising an eighth function of detecting a level of noise other than noise due to performing said fuel injection amount learning, said third function setting said upper limit value such that said upper limit value increases with increase of said level of said noise detected by said eighth function.

3. The fuel injection control apparatus according to claim 1, further comprising a pressure-reducing device which operates to reduce said injection pressure, and an eighth function of controlling said pressure-reducing device to operate to reduce said injection pressure when said injection amount learning is completed, said third function setting said upper limit value such that said upper limit value increases with increase of a pressure reducing capability of said pressure-reducing device.

4. The fuel injection control apparatus according to claim 1, wherein said third function sets said upper limit value such that said upper limit value increases with decrease of time needed to perform said injection amount learning.

5. The fuel injection control apparatus according to claim 1, wherein said first function determines that said learning conditions are satisfied when an engine controlled by said fuel injection control apparatus is not supplied with fuel from said fuel injection valve, and accordingly is decelerating.

6. The fuel injection control apparatus according to claim 1, further comprising an eighth function of detecting said injection pressure, said second function being configured to cause said fuel injection valve to carry out a fuel injection to reduce noise when a normal injection control is resumed after said injection amount learning is completed if a value of said injection pressure when said injection amount learning is completed is higher by a predetermined value than a value of said injection pressure when said injection amount learning has not been performed.

7. A fuel injection system comprising:

a fuel supply pump for pressure-feeding fuel;

a common rail for accumulating fuel pressure-fed from said fuel supply pump;

a fuel injection valve for injecting fuel accumulated in said common rail; and a fuel injection control apparatus for controlling a fuel injection amount of said fuel injection valve;

said fuel injection control apparatus comprising:

a first function of making a determination of whether or not learning conditions are satisfied to allow a fuel injection amount learning to be performed for said fuel injection valve;

a second function of directing a commanded fuel injection amount in said fuel injection amount learning to said fuel injection valve if result of said determination is affirmative;

a third function of setting an upper limit value of an injection pressure in said fuel injection amount learning;

a fourth function of setting a target injection pressure within a range not exceeding said upper limit value in said fuel injection amount learning;

a fifth function of setting said injection pressure to said target injection pressure;

a sixth function of detecting an actual fuel injection amount of said fuel injection valve; and a seventh function of correcting an amount of fuel injected by said fuel injection valve on the basis of a difference between said commanded fuel injection amount and said actual fuel injection amount at said target injection pressure as a learned correction value.

* * * * *